United States Patent [19]

Brown

[11] 4,119,387

[45] Oct. 10, 1978

[54] PAVEMENT JOINT STRUCTURES

[75] Inventor: Delmont D. Brown, North Baltimore, Ohio

[73] Assignee: The D. S. Brown Company, North Baltimore, Ohio

[21] Appl. No.: 816,330

[22] Filed: Jul. 18, 1977

[51] Int. Cl.[2] ..... E01C 11/02

[52] U.S. Cl. ..... 404/69; 404/64; 14/16.5; 52/396

[58] Field of Search ..... 404/64, 65, 68, 69; 52/396, 403; 14/16.5

[56] References Cited

U.S. PATENT DOCUMENTS

| | | | |
|---|---|---|---|
| 3,626,822 | 12/1971 | Koster | 404/69 |
| 3,762,826 | 10/1973 | Bowman | 404/64 |
| 3,778,176 | 12/1973 | Pax | 404/65 |
| 3,900,677 | 8/1975 | Barber | 404/64 X |
| 4,030,156 | 6/1977 | Raymond | 404/69 X |

*Primary Examiner*—Nile C. Byers

*Attorney, Agent, or Firm*—Keil, Thompson & Shurtleff

[57] ABSTRACT

Pavement joint structures utilizing laterally spaced, elongated metal frames with a four-sided, compartmented, elongated, elastomer seal locked in the frames and spanning the space, the seal having a double arch, nadir-to-apex internal web structure.

5 Claims, 2 Drawing Figures

PAVEMENT JOINT STRUCTURES

Figure 1:
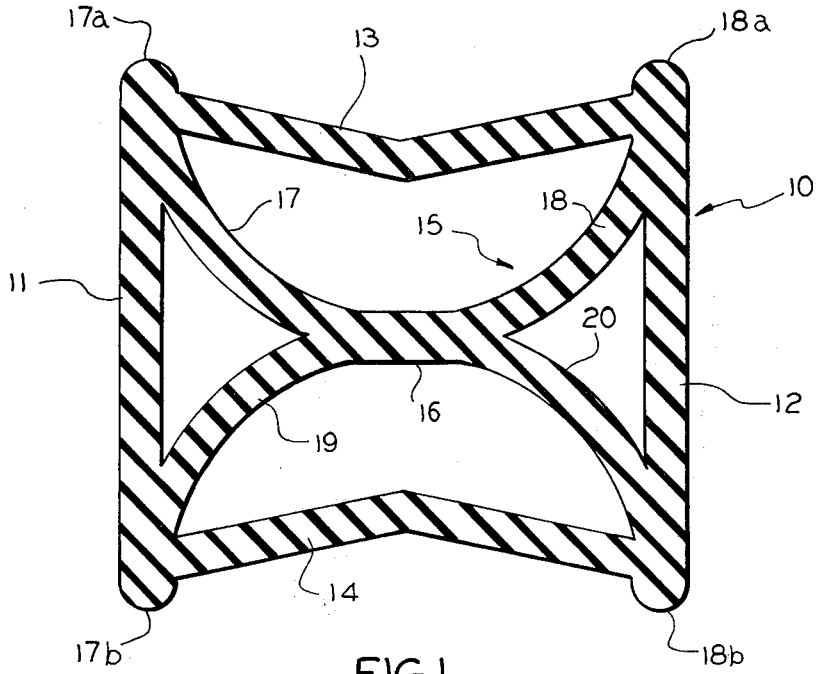

This invention relates to improvements in pavement joint structures and to improvements in elastomer seals for pavement joints with laterally spaced, elongated, longitudinal, metal, side frames on opposite sides of the joint, optionally having one or more spaced, elongated, intermediary, metal rails between the side frames. The side frames and rails have seal-receiving means to lock in the space (s) therebetween an elongated, elastomer seal with interlock means insertable into the seal-receiving means. The elongated seal comprises a four-sided, elongated, elastomer extrusion having the interlock means, e.g., longitudinal lips or beads, at its four corners and a symmetric, longitudinal, internal web structure composed of a nadir-to-apex-united, downwardly arched, upper arch and an upwardly arched, lower arch in or near the four corners of the seal. These arches add support for the seal during the extrusion and curing of the elastomer and also urge, during lateral compression of the elastomer seal, the respective longitudinal lips or beads into the seal-receiving means, e.g., longitudinal grooves in the frames and rails.

The subject joints and elastomer seals used therewith are of the interlocking type described in U.S. Pat. No. 3,636,822. The latter discloses pavement joints with laterally spaced side and intermediate, elongated, metal frame members with interlocking, hollow, four-sided, elongated, elastomer seals spanning the spaces between the frame members. As in the subject invention, the seal has on each corner a longitudinal lip or bead which interlocks with four corresponding longitudinal grooves in the frame members. The interior space between the four walls has a diagonal web at each corner and an optional, vertical, center web and is otherwise substantially free from other interior web members.

It is difficult to maintain precise cross-sections corresponding to the extrusion die in compartmented, interiorly webbed, extruded elastomer seals, yet constant cross-sections are important to the correct interlock between the seal's lips or beads and the frame's grooves. The double arch internal web structure of the subject seals is of significant importance in the capability of said seals to maintain substantially the same cross-section as that of the extrusion dies both in the freshly extruded, uncured state as well as during the heat curing thereof.

Additionally, the ends of the arches are oriented so that they merge smoothly with the planar side walls of the shell contiguous to the four corners. The longitudinal, interlocking lips or beads at the four corners of the seal are projecting extensions of the side walls. Therefore, when the seal is laterally compressed, a portion of the elastomer recovery forces of the distorted arches is transmitted via the ends thereof to the four corners of the seal in a manner biasing the longitudinal lips or beads into the corresponding longitudinal grooves of the frame, i.e., vertically upwardly or downwardly.

Figure 2:
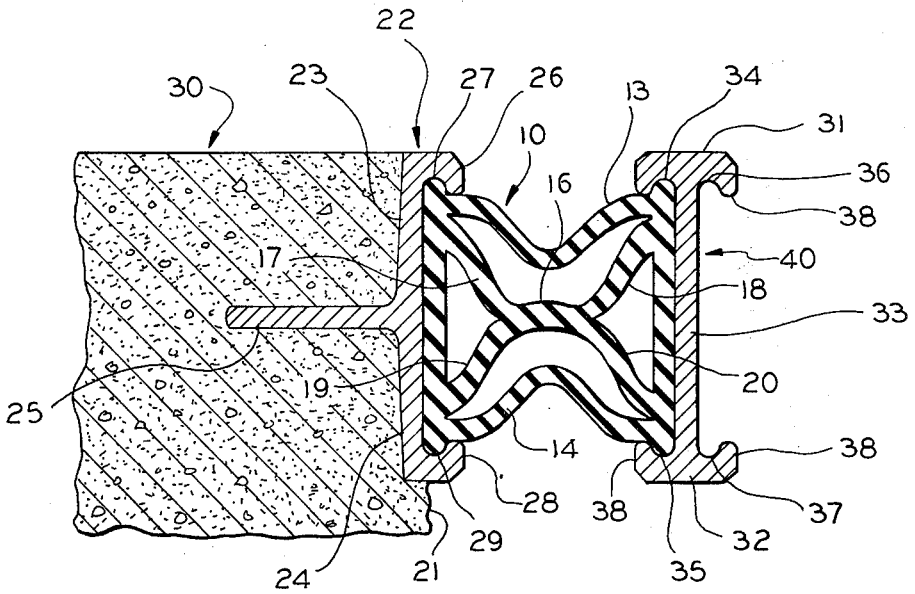

The aforesaid advantages and improvements attainable by the pavement joint structures and the elastomer seals of the invention, as well as others set out below, will be appreciated from the following description of a preferred embodiment of the invention, which is illustrated in the drawing, wherein:

FIG. 1 is a transverse cross-section of the elastomer seal in an uncompressed state; and FIG. 2 is a transverse cross-section of a part of a pavement joint with the seal under about 30% compression.

Referring to the drawing, the elongated, extruded, hollow elastomer seal 10, in transverse cross-section or end elevation, is a four-sided, webbed body having a pair of substantially planar, substantially parallel side walls 11,12 connected by a shallow-V top wall 13 and an inverted shallow-V bottom wall 14. At each of the four corners, the seal has a longitudinal lip or bead 17*a*, 17*b*, 18*a* and 18*b*, each of which may be viewed as an extension of the respective side wall beyond the corner and lies in the plane of its side wall.

The hollow interior of the seal 10 contains, integral with the outer walls, an interior, symmetric, nadir-to-apex double arch web structure 15 comprising a short, horizontal, planar medial section 16 and four arcuate arch legs 17, 18, 19 and 20. The respective ends of these legs merge smoothly with the respective side walls 11, 12 contiguous to the four corners of the seal. The upper arch 16, 17, 18 curves oppositely to the lower arch 16, 19, 20. The nadir of the upper arch and the apex of the lower arch merge to form the thicker medial section 16.

An exemplary use of the seal in a pavement or bridge joint is shown in FIG. 2, which depicts one side of the joint —a gap or space between contiguous pavement sections which allows for expansion and contraction of the pavement wherein the joint narrows or widens. The pavement 30, shown in fragment, has a joint face 21 on which is mounted an elongated, metal side frame 22. The opposite side of the joint has a like side frame 22 on its joint face.

The side frame 22 is composed of a thick, tapered upper side wall 23 and a lower side wall 24, at the juncture of which is positioned a laterally projecting anchor rib 25 which is embedded in the concrete of the pavement 30. A downwardly projecting lip 26 forms with the side wall 23 a downwardly facing slot or groove 27. An upwardly projecting lip 28 forms with the side wall 24 an upwardly facing longitudinal slot or groove 29.

The grooves 27 and 29 are sized to receive and tightly hold the longitudinal lips or beads 17*a*,17*b* of the seal with the side wall 11 of the seal lying flat against the side walls 23,24 of the side frame 22.

In narrow joints, the longitudinal lips or beads 18*a* and 18*b* of the seal would be seated in a similar side frame mounted on the opposite face of the joint. In the illustrated embodiment, one or more rails 40, extending longitudinally of the joint, are provided in the space between the side frames 22. Such rails are supported by any suitable means (not shown).

The rails 40 have a transverse cross-section in the I-configuration provided by the upper and cross legs 31,32 and the vertical leg 33. At the end of each cross leg, the rail has lips 38 which form together with the vertical leg 33 four longitudinal slots or grooves 34, 35, 36, 37 providing opposed pairs of such slots or grooves on opposite sides of the vertical leg 33. Each pair receives the longitudinal beads or lips 17*a*, 17*b* or 18*a*,18*b* of the seal 10 in the manner illustrated for the pair 34,35 in FIG. 2.

The spacing between the side frame 22 and the rail 40 in FIG. 2 is such that the seal 10 is about 30 percent collapsed relative to its nominal width in the unstressed state (FIG. 1). As seen in FIG. 2, the seal 10 has a substantially symmetric shape at about 30 percent compression. Because the medial section 16 of the seal has a thickness in the order of 1.2 to 2 times that of the curvate legs 17, 18, 19 and 20, it remains relatively straight while the curvate legs fold or bend as the seal is compressed. This bending or folding of the curvate legs results in a thrust by the legs where they join the side walls 11,12, a vector of which thrust keeps the longitudinal lips or beads 17*a*, 17*b*, 18*a* and 18*b* in the respective longitudinal slots or grooves 27,29 and 34,35.

Also, the shallow V top and bottom walls 13,14 bend or fold inwardly in a substantially symmetric configuration up to about 30–50 percent compression of the seal 10. At higher degrees of compression, e.g., up to about 60%, the medial section, curvate legs and top and bottom walls bend and fold in a nonsymmetric, compacted configuration By way of illustration, a seal having a nominal width of 3¾ to 4 inches and a height of 3 9/16 to about 3¾inches has side walls, top and bottom walls and arch legs each of about ¼ inch thicknesses. The lip or beads at the four corners are slightly wider, i.e., about ⅜ inch. The planar, medial section 16 is about 5/16 inch thick and is about ½ inch long.

It is thought that the invention and its numerous attendant advantages will be fully understood from the foregoing description, and it is obvious that numerous changes may be made in the form, construction and arrangement of the several parts without departing from the spirit or scope of the invention, or sacrificing any of its attendant advantages, the form herein disclosed being a preferred embodiment for the purpose of illustrating the invention.

The invention is hereby claimed as follows:

1. An interlockable elastomer seal for joints with spaced metal joint members having interlock means adapted to interlock with interlock means of the seal, said seal comprising an elongated, four sided, webbed elastomer seal having substantially planar side walls connected by a top wall and a bottom wall and a double arch, internal, elastomer web structure in which the nadir of a downwardly arched, upper arch and the apex of an upwardly arched, lower arch are united and the four ends of the two arches merge smoothly with respective side walls of the seal substantially at the four respective corners thereof, and interlock means on the four corners of said seal adapted to interlock with the interlock means of said metal joint member.

2. A seal as claimed in claim 1 wherein said interlock means of said metal joint members comprises a pair of opposed, longitudinal grooves on each metal joint member, and said interlock means on the four corners of said seal comprises a longitudinal bead on each corner.

3. A seal as claimed in claim 1 wherein the united portions of said arches embodies a short, elastomer section at right angles to said side walls.

4. A seal as claimed in claim 1 wherein the united portions of said arches embodies a short, elastomer section at right angles to said side walls, said short section having a thickness in the order of 1.2 to 2 times the thickness of the four legs of the united arches.

5. A seal as claimed in claim 1 wherein said top wall has a shallow-V transverse cross-section and said bottom wall has an inverted, shallow-V transverse cross-section, whereby said walls are adapted to fold inwardly when the seal is laterally compressed.

* * * * *